US008082994B2

(12) United States Patent
Nguyen et al.

(10) Patent No.: US 8,082,994 B2
(45) Date of Patent: Dec. 27, 2011

(54) METHODS FOR ENHANCING FRACTURE CONDUCTIVITY IN SUBTERRANEAN FORMATIONS

(75) Inventors: Philip D. Nguyen, Duncan, OK (US); Richard D. Rickman, Duncan, OK (US); Jason Bryant, Duncan, OK (US); Jimmie D. Weaver, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 62 days.

(21) Appl. No.: 11/633,889

(22) Filed: Dec. 5, 2006

(65) Prior Publication Data

US 2008/0128131 A1 Jun. 5, 2008

(51) Int. Cl.
*E21B 43/26* (2006.01)
*E21B 43/267* (2006.01)

(52) U.S. Cl. ..... 166/280.1; 166/295; 166/276; 166/281

(58) Field of Classification Search ..... 166/270, 166/271, 272.2, 279, 280.1, 400
See application file for complete search history.

(56) References Cited

U.S. PATENT DOCUMENTS 3,349,851 A * 10/1967 Huitt et al. ..... 166/280.1
3,757,864 A * 9/1973 Crawford et al. ..... 166/308.4
3,815,680 A * 6/1974 McGuire et al. ..... 166/281
4,078,609 A * 3/1978 Pavlich ..... 166/271
4,527,627 A * 7/1985 Graham et al. ..... 166/280.2
4,982,793 A 1/1991 Holtmyer et al. ..... 166/305.1
5,067,565 A 11/1991 Holtmyer et al. ..... 166/305.1
5,122,549 A 6/1992 Holtmyer et al. ..... 523/130
5,799,734 A * 9/1998 Norman et al. ..... 166/278
5,833,000 A 11/1998 Weaver et al. ..... 166/276
5,839,510 A 11/1998 Weaver et al. ..... 166/276
5,846,915 A 12/1998 Smith et al. ..... 507/269
5,853,048 A 12/1998 Weaver et al. ..... 166/279
5,960,880 A * 10/1999 Nguyen et al. ..... 166/280.1
6,439,309 B1 * 8/2002 Matherly et al. ..... 166/276
7,213,651 B2 * 5/2007 Brannon et al. ..... 166/308.2
2005/0211439 A1 * 9/2005 Willett et al. ..... 166/308.1
2005/0274517 A1 12/2005 Blauch et al. ..... 166/280.2
2005/0277554 A1 12/2005 Blauch et al. ..... 507/224
2009/0044945 A1 * 2/2009 Willberg et al. ..... 166/308.1

* cited by examiner

*Primary Examiner* — Angela M DiTrani
(74) *Attorney, Agent, or Firm* — Robert A. Kent; McDermott Will & Emery LLP

(57) ABSTRACT

Methods of enhancing the conductivity of fractures in subterranean formations comprising: providing a propped fracture in a subterranean formation wherein a plurality of proppant particulates reside in at least a portion of the fracture; providing a displacement fluid; introducing the displacement fluid into the propped fracture in the subterranean formation at a rate that is at least the matrix rate of the subterranean formation; and allowing the displacement fluid to displace at least a portion of the plurality of proppant particulates, thereby forming at least one channel in the propped fracture.

17 Claims, 5 Drawing Sheets

METHODS FOR ENHANCING FRACTURE CONDUCTIVITY IN SUBTERRANEAN FORMATIONS

BACKGROUND

The present invention relates to methods useful in subterranean operations, and more particularly, to methods of enhancing the conductivity of fractures in subterranean formations.

Fracturing treatments are commonly used in subterranean operations, among other purposes, to stimulate the production of desired fluids (e.g., oil, gas, water, etc.) from a subterranean formation. For example, hydraulic fracturing treatments generally involve pumping a treatment fluid (e.g., a fracturing fluid) into a well bore that penetrates a subterranean formation at a sufficient hydraulic pressure to create or enhance one or more cracks, or "fractures," in the subterranean formation. "Enhancing" one or more fractures in a subterranean formation, as that term is used herein, is defined to include the extension or enlargement of one or more natural or previously created fractures in the subterranean formation. The creation and/or enhancement of these fractures, among other things, may enhance the flow of fluids through the subterranean formation, which may be produced out of the subterranean formation (e.g., into and out of a well bore penetrating at least a portion of the subterranean formation) more readily. The rate of flow of fluids through a portion of a subterranean formation is referred to herein as the "conductivity" of that portion of the formation. Such fracturing treatments also may be performed in combination with other subterranean treatments useful in the particular formation, such as gravel packing and/or acidizing treatments, which may be referred to as "frac-packing" and "frac-acidizing" treatments, respectively.

In order to maintain and/or enhance the conductivity of a fracture in a subterranean formation, particulates (often referred to as "proppant particulates") may be deposited in the open space of the fracture, for example, by introducing a fluid carrying those proppant particulates into the subterranean formation. The proppant particulates may, inter alia, prevent the fractures from fully closing upon the release of hydraulic pressure, forming conductive channels through which fluids may flow to the well bore. Once at least one fracture is created and the proppant particulates are substantially in place in the fracture, the treatment fluid carrying the proppant particulates may be "broken" (i.e., the viscosity of the fluid is reduced), and the treatment fluid may be recovered from the formation. The process of placing proppant particulates in a fracture is referred to herein as "propping" the fracture. Although it is desirable to use proppant particulates in maintaining the conductivity of a fracture, the propped fracture should remain sufficiently permeable to allow the flow of fluids therethrough.

A displacement fluid also may be used in a subterranean formation that comprises one or more fractures, inter alia, to displace the fracturing fluid into the formation and/or to move the proppant particulates into the open space of the fracture. For example, the displacement fluid may be pumped into the subterranean formation immediately after the fracturing fluid to move the proppant out of the well bore into the open space of the fracture. The use of the displacement fluid may, inter alia, allow the proppant particulates to be placed deeper within the fracture than with the use of a fracturing fluid alone, which may enhance the conductivity of the fracture.

However, conventional methods of using displacement fluids in propped fractures may be problematic. If the proppant particulates in a propped fracture are displaced too far into the subterranean formation, they may be moved away from the near-well bore area, where the proppant particulates may not be able to hold open fractures so as to remain in communication with the well bore. This may allow the fracture to close, which can obstruct the conductive flow path through the fracture to the well bore and may decrease the production of fluids from the well.

SUMMARY

The present invention relates to methods useful in subterranean operations, and more particularly, to methods of enhancing the conductivity of fractures in subterranean formations.

In one embodiment, the present invention provides a method comprising: providing a propped fracture in a subterranean formation wherein a plurality of proppant particulates reside in at least a portion of the fracture; providing a displacement fluid; introducing the displacement fluid into the propped fracture in the subterranean formation at a rate equal to or greater than the matrix rate of the subterranean formation but less than the rate sufficient to form or enhance a fracture in the subterranean formation; and forming at least one channel in the propped fracture.

In another embodiment, the present invention provides a method comprising: providing a treatment fluid; contacting a subterranean formation with the treatment fluid at or above a pressure sufficient to create or enhance one or more fractures in a portion of the subterranean formation; providing a plurality of proppant particulates; introducing the plurality of proppant particulates into the one or more fractures to form a propped fracture in the subterranean formation wherein the plurality of proppant particulates reside in at least a portion of the fracture; providing a displacement fluid; introducing the displacement fluid into the propped fracture in the subterranean formation at a rate equal to or greater than the matrix rate of the subterranean formation but less than the rate sufficient to form or enhance a fracture in the subterranean formation; and forming at least one channel in the propped fracture.

In another embodiment, the present invention provides a method comprising: providing a propped fracture in a subterranean formation wherein a plurality of proppant particulates reside in at least a portion of the fracture; providing a proppant-free displacement fluid; introducing the proppant-free displacement fluid into the propped fracture in the subterranean formation at a rate equal to or greater than the matrix rate of the subterranean formation but less than the rate sufficient to form or enhance a fracture in the subterranean formation; and forming at least one proppant-free channel in the propped fracture.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

Figure 1:
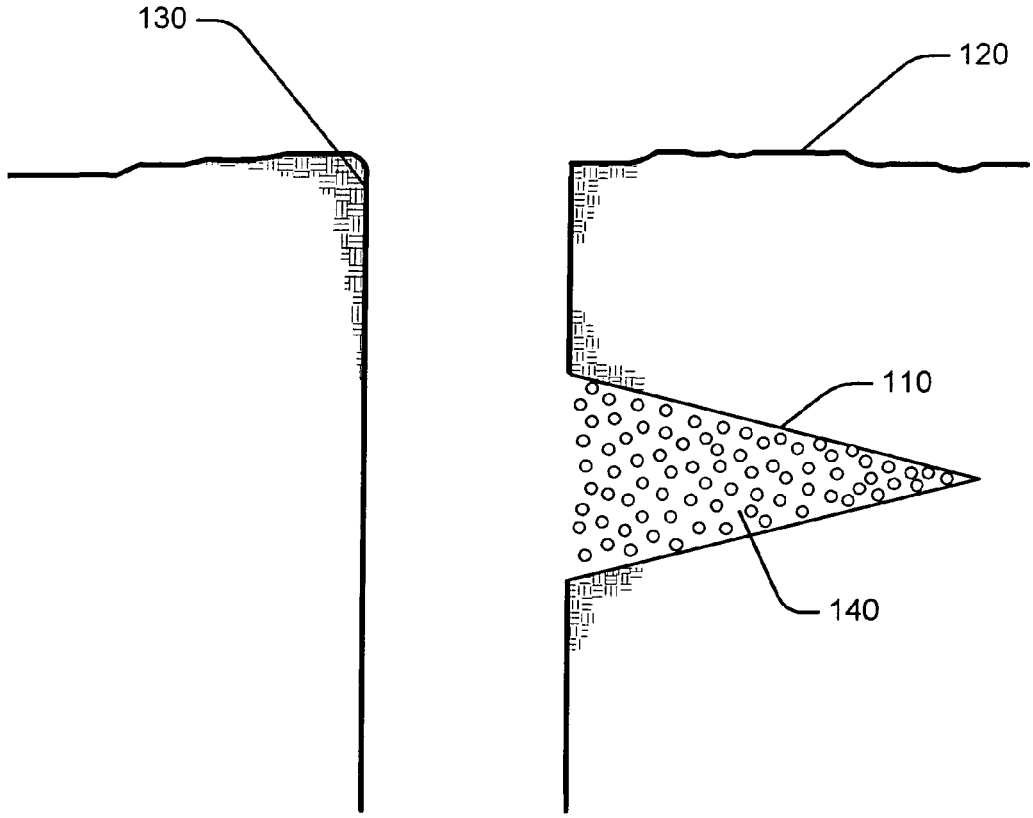
FIG. 1 illustrates a fracture that may be treated in certain embodiments of the present invention.

The present invention relates to methods useful in subterranean operations, and more particularly, to methods of enhancing the conductivity of fractures in subterranean formations.

The methods of the present invention generally comprise: providing or creating a propped fracture in a subterranean formation wherein a plurality of proppant particulates reside in at least a portion of the fracture; providing a displacement fluid; introducing the displacement fluid into the subterranean formation at a rate equal to or greater than the matrix rate of the subterranean formation but less than the rate sufficient to form or enhance a fracture in the subterranean formation; and forming at least one channel in the propped fracture. The term "fracture" is defined herein to refer to any crack or open space that penetrates at least a portion of a subterranean formation, which may exist naturally, be created in the course of a subterranean treatment, or some combination thereof (e.g., a naturally-occurring fracture that is enlarged or enhanced in the course of a subterranean treatment). The "matrix rate" of a subterranean formation is defined herein to refer to the flow rate at which a fluid is permitted to pass through or out of the matrix of particulates comprising the subterranean formation when the rate at which the fluid is injected into the matrix of particulates is below the rate that will form or enhance one or more fractures in the subterranean formation. The term "propped fracture" is defined herein to refer to any fracture in a portion of a subterranean formation that contains a plurality of proppant particulates, which, for example, may be arranged so as to form a "proppant pack." A "proppant pack" is defined herein as a collection or mass of proppant particulates within a fracture, which, for example, may be arranged in the form of a matrix. The term "channel" is defined herein to refer to a passage or tunnel in a solid mass or matrix of particulates through which a fluid (e.g., liquid and/or gas) may flow. The channels formed in the propped fracture using the methods of the present invention may, inter alia, increase the conductivity of the propped fracture and/or the subterranean formation, thereby increasing the productivity of a well penetrating that formation.

The propped fracture in the methods of the present invention may comprise any fracture in a portion of a subterranean formation wherein a plurality of proppant particulates reside. The propped fracture may exist naturally in the subterranean formation, or may be created, enhanced, or propped during or prior to performing a treatment according to the present invention. In certain embodiments, a resin-coated proppant may be placed in a fracture to create the propped fracture, and the displacement fluid may be introduced into that propped fracture in accordance with the present invention before the resin on the resin-coated proppant is allowed to consolidate or cure.

In certain embodiments, the subterranean formation may be penetrated by a well bore. The well bore may be an open hole, a cased or partially-cased hole (e.g., a well bore that comprises one or more casing strings therein), or a combination thereof. In embodiments where the well bore comprises a cased or partially-cased hole, the propped fracture may communicate with the interior of the well bore through one or more perforations in the casing string(s).

An example of a propped fracture that may be present in the methods of the present invention is illustrated in FIG. 1. In this embodiment, the fracture 110 in the subterranean formation 120 is in communication with a well bore 130 and contains a plurality of proppant particulates arranged in a proppant pack 140. The fracture may be naturally-occurring or may be formed and/or enhanced in the course of one or more subterranean treatments, such as hydraulic fracturing treatments, frac-acidizing treatments, "frac-pack" treatments, and the like. In certain embodiments, a portion of the fracture may have been formed naturally, and another portion of the fracture may have been created or enhanced in the course of one or more subterranean treatments. In certain embodiments, the fracture may be created or enhanced just prior to and/or during a method of the present invention. In certain embodiments, the plurality of proppant particulates may have been present in the propped fracture prior to any treatment performed therein, or they may have been placed in the fracture in the course of one or more subterranean treatments, such as those listed above. In certain embodiments, the proppant particulates may be placed in the fracture to form the propped fracture just prior to and/or during the methods of the present invention. The process of placing proppant particulates in a fracture is referred to herein as "propping" the fracture.

The proppant particulates in the propped fracture in the present invention may comprise any particulate material known in the art. Proppant particulates may be comprised of any material suitable for use in subterranean operations. Examples include, but are not limited to, sand, bauxite, ceramic materials, glass materials (e.g., glass beads), polymer materials, non-stick coating materials such as TEFLON® materials, nut shell pieces, seed shell pieces, cured resinous particulates comprising nut shell pieces, cured resinous particulates comprising seed shell pieces, fruit pit pieces, cured resinous particulates comprising fruit pit pieces, wood, composite particulates, and combinations thereof. Composite particulates also may be used, wherein suitable composite materials may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, ground nut/seed shells or husks, saw dust, ground cellulose fiber, and combinations thereof. Typically, the particulates have a size in the range of from about 2 to about 400 mesh, U.S. Sieve Series. In particular embodiments, particulates size distribution ranges are one or more of 6/12 mesh, 8/16, 12/20, 16/30, 20/40, 30/50, 40/60, 40/70, or 50/70 mesh. It should be understood that the term "particulate," as used in this disclosure, includes all known shapes of materials including substantially spherical materials, fibrous materials, polygonal materials (such as cubic materials) and mixtures thereof. Moreover, the proppant particulates may comprise fibrous materials that may be used, inter alia, to bear the pressure of a closed fracture.

In some embodiments, the proppant particulates (or some portion thereof) may be coated with a resin, tackifying agent, gelable liquid composition, a derivative thereof, or a combination thereof, which may comprise any suitable resin, tackifying agent, or gelable liquid composition known to those of ordinary skill in the art. The term "coated" does not imply any particular degree of coverage of the proppant particulates with a resin, tackifying agent, and/or gelable liquid composition. The proppant particulates may be coated by any suitable method as recognized by one skilled in the art with the benefit of this disclosure. In certain embodiments, the resin, tackifying agent, and/or gelable liquid composition may facilitate the consolidation and/or adherence of the plurality of proppant particulates together to form a solid mass, for example, after being placed in the fractures and channels have been formed. The resin, tackifying agent, and/or gelable liquid composition may be formulated so as to consolidate and/or adhere the plurality of proppant particulates to one another immediately, or it may be formulated such that it becomes "activated" after a certain amount of time or when contacted with another substance, at which point it becomes capable of consolidating and/or adhering the plurality of proppant particulates to one another. In those embodiments where a portion of the proppant particulates are allowed to consolidate or adhere to one another, they may be allowed to do so at any point during the course of or after performing any portion of the methods of the present invention. For example, a portion of the proppant particulates may be allowed to consolidate or adhere to one another after at least one channel is formed in the propped fracture.

Resins suitable for coating the proppant particulates in certain embodiments of the present invention may include any resin known in the art that is capable of forming a hardened, consolidated mass. Many such resins are commonly used in subterranean operations, and some suitable resins may include two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that when pumped downhole, they may be cured using only time and/or temperature. Other suitable resins, such as furan resins may require a time-delayed catalyst or an external catalyst to help activate the polymerization of the resins if the cure temperature is low (e.g., less than 250° F.), but may cure under the effect of time and/or temperature if the formation temperature is above about 250° F. By way of further example, selection of a suitable resin may be affected by the temperature of the subterranean formation. For subterranean formations having a bottom hole static temperature ("BHST") ranging from about 300° F. to about 600° F., a furan-based resin may be suitable. For subterranean formations having a BHST ranging from about 200° F. to about 400° F., either a phenolic-based resin or a one-component HT epoxy-based resin may be suitable. For subterranean formations having a BHST of at least about 175° F., a phenol/phenol formaldehyde/furfuryl alcohol resin also may be suitable. It is within the ability of one skilled in the art, with the benefit of this disclosure, to select a suitable resin for use in embodiments of the present invention and to determine whether a catalyst is required to trigger curing.

One resin coating material suitable for use in the present invention is a two-component epoxy based resin comprising a hardenable resin component and a hardening agent component. The hardenable resin component is comprised of a hardenable resin and an optional solvent. The second component is the liquid hardening agent component, which is comprised of a hardening agent, a silane coupling agent, a surfactant, an optional hydrolyzable ester for, inter alia, breaking gelled fracturing fluid films on the proppant particles, and an optional liquid carrier fluid for, inter alia, reducing the viscosity of the liquid hardening agent component. It is within the ability of one skilled in the art with the benefit of this disclosure to determine if and how much liquid carrier fluid is needed.

Where the resin coating material used in the present invention is a furan-based resin, suitable furan-based resins include, but are not limited to, furfuryl alcohol, a mixture furfuryl alcohol with an aldehyde, and a mixture of furan resin and phenolic resin. Where the resin coating material of the present invention is a phenolic-based resin, suitable phenolic-based resins include, but are not limited to, terpolymers of phenol, phenolic formaldehyde resins, and a mixture of phenolic and furan resins. Where the resin coating material of the present invention is a high-temperature ("HT") epoxy-based resin, suitable HT epoxy-based components included, but are not limited to, bisphenol A-epichlorohydrin resin, polyepoxide resin, novolac resin, polyester resin, glycidyl ethers and mixtures thereof.

Yet another resin suitable for use in the methods of the present invention is a phenol/phenol formaldehyde/furfuryl alcohol resin comprising from about 5% to about 30% phenol, from about 40% to about 70% phenol formaldehyde, from about 10 to about 40% furfuryl alcohol, from about 0.1% to about 3% of a silane coupling agent, and from about 1% to about 15% of a surfactant. In the phenol/phenol formaldehyde/furfuryl alcohol resins suitable for use in the methods of the present invention, suitable silane coupl ing agents include, but are not limited to, n-2-(aminoethyl)-3-aminopropyltrimethoxysilane, 3-glycidoxypropyltrimethoxysilane, and n-beta-(aminoethyl)-gamma-aminopropyl trimethoxysilane. Suitable surfactants include, but are not limited to, an ethoxylated nonyl phenol phosphate ester, mixtures of one or more cationic surfactants and one or more non-ionic surfactants, and an alkyl phosphonate surfactant.

Tackifying agents suitable for coating the proppant particulates in certain embodiments of the present invention include non-aqueous tackifying agents, aqueous tackifying agents, and silyl-modified polyamides. One type of tackifying agent suitable for use in the present invention is a non-aqueous tackifying agent. One group of suitable non-aqueous tackifying agents comprises polyamides that are liquids or in solution at the temperature of the subterranean formation such that they are, by themselves, non-hardening when introduced into the subterranean formation. One example of such a non-aqueous tackifying agent comprises a condensation reaction product comprised of a polyacid and a polyamine. Such condensation reaction products include compounds such as mixtures of $C_{36}$ dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Such acid compounds are commercially available from companies such as Witco Corporation, Union Camp, Chemtall, and Emery Industries. The reaction products are available from, for example, Champion Technologies, Inc. and Witco Corporation. Additional compounds which may be used as non-aqueous tackifying compounds include liquids and solutions of, for example, polyesters, polycarbonates and polycarbamates, natural resins such as shellac and the like. Other suitable non-aqueous tackifying agents are described in U.S. Pat. No. 5,853,048 issued to Weaver, et al. and U.S. Pat. No. 5,833,000 issued to Weaver, et al., the relevant disclosures of which are herein incorporated by reference.

In certain embodiments, non-aqueous tackifying agents suitable for use in the present invention may be either used such that they form a non-hardening coating or they may be combined with a multifunctional material capable of reacting with the non-aqueous tackifying agent to form a hardened coating. A "hardened coating" as used herein means that the reaction of the tackifying compound with the multifunctional material will result in a substantially non-flowable reaction product that exhibits a higher compressive strength in a consolidated agglomerate than the tackifying compound alone with the particulates. In this instance, the non-aqueous tackifying agent may function similarly to a hardenable resin. Multifunctional materials suitable for use in the present invention include, but are not limited to, aldehydes such as formaldehyde, dialdehydes such as glutaraldehyde, hemiacetals or aldehyde releasing compounds, diacid halides, dihalides such as dichlorides and dibromides, polyacid anhydrides such as citric acid, epoxides, furfuraldehyde, glutaraldehyde or aldehyde condensates and the like, and combinations thereof. In some embodiments of the present invention, the multifunctional material may be mixed with the tackifying agent in an amount of from about 0.01 to about 50 percent by weight of the tackifying agent to effect formation of the reaction product. In some embodiments, the multifunctional material is present in an amount of from about 0.5 to about 1 percent by weight of the tackifying agent. Some other suitable multifunctional materials are described in U.S. Pat. No. 5,839,510 issued to Weaver et al., the relevant disclosure of which is herein incorporated by reference.

Solvents suitable for use with the non-aqueous tackifying agents of the present invention include any solvent that is compatible with the non-aqueous tackifying agent and achieves the desired viscosity effect. Examples of solvents suitable for use in the present invention include, but are not limited to, butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, fatty acid methyl esters, and combinations thereof. It is within the ability of one skilled in the art, with the benefit of this disclosure, to determine whether a solvent is needed and, if so, how much.

Aqueous tackifying agents suitable for use in the present invention are not significantly tacky when placed onto a particulate, but are capable of being "activated" (that is destabilized, coalesced and/or reacted) to transform the compound into a sticky, tackifying compound at a desirable time. Such activation may occur before, during, or after the coated proppant particulate is placed in the subterranean formation. In some embodiments, a pre-treatment first may be contacted with the surface of a particulate to prepare it to be coated with an aqueous tackifying agent. Suitable aqueous tackifying agents are generally charged polymers that comprise compounds that, when in an aqueous solvent or solution, will form a non-hardening coating (by itself or with an activator) and, when placed on a particulate, will increase the continuous critical resuspension velocity of the particulate when contacted by a stream of water. The aqueous tackifying agent may enhance the grain-to-grain contact between the particulates within the formation (be they proppant particulates, formation fines, or other particulates), which may aid in the consolidation of the particulates into a cohesive, flexible, and permeable mass.

Examples of aqueous tackifying agents suitable for use in the present invention include, but are not limited to, acrylic acid polymers, acrylic acid ester polymers, acrylic acid derivative polymers, acrylic acid homopolymers, acrylic acid ester homopolymers (such as poly(methyl acrylate), poly(butyl acrylate), and poly(2-ethylhexyl acrylate)), acrylic acid ester co-polymers, methacrylic acid derivative polymers, methacrylic acid homopolymers, methacrylic acid ester homopolymers (such as poly(methyl methacrylate), poly(butyl methacrylate), and poly(2-ethylhexyl methacrylate)), acrylamido-methyl-propane sulfonate polymers, acrylamido-methyl-propane sulfonate derivative polymers, acrylamido-methyl-propane sulfonate co-polymers, and acrylic acid/acrylamido-methyl-propane sulfonate co-polymers and combinations thereof. Methods of determining suitable aqueous tackifying agents and additional disclosure on aqueous tackifying agents can be found in U.S. Patent Application Publication No. 2005/0277554, filed Jun. 9, 2004, and U.S. Patent Publication No. 2005/0274517, filed Jun. 9, 2004, the relevant disclosures of which are hereby incorporated by reference.

Silyl-modified polyamide compounds suitable for coating the proppant particulates in certain embodiments of the present invention may be described as substantially self-hardening compositions that are capable of at least partially adhering to particulates in the unhardened state, and that are further capable of self-hardening themselves to a substantially non-tacky state to which individual particulates such as formation fines will not adhere to, for example, in formation or proppant pack pore throats. Such silyl-modified polyamides may be based, for example, on the reaction product of a silating compound with a polyamide or a mixture of polyamides. The polyamide or mixture of polyamides may be one or more polyamide intermediate compounds obtained, for example, from the reaction of a polyacid (e.g., diacid or higher) with a polyamine (e.g., diamine or higher) to form a polyamide polymer with the elimination of water. Other suitable silyl-modified polyamides and methods of making such compounds are described in U.S. Pat. No. 6,439,309 issued to Matherly et al., the relevant disclosure of which is herein incorporated by reference.

The channels in the propped fracture in the methods of the present invention are formed when a displacement fluid is introduced into the subterranean formation at a rate equal to or greater than the matrix rate but less than the rate sufficient to form or enhance a fracture in the subterranean formation. In certain embodiments, this may induce a "viscous fingering effect" whereby the displacement fluid displaces at least a portion of the proppant particulates in the propped fracture away from the near-well bore area of the fracture further into the subterranean formation, and/or compacts at least a portion of the proppant particulates in the propped fracture to create channels therein.

Generally, the matrix rate of a subterranean formation is the rate at which a fluid is permitted to pass through or out of the matrix of particulates comprising the subterranean formation without fracturing the formation. The displacement fluid should be introduced into the subterranean formation at a rate above this matrix rate. In certain embodiments, the matrix rate of the subterranean formation may be about 0.25 to about 3 barrels per minute. In certain embodiments, the flow rate sufficient to form or enhance a fracture in the subterranean formation may be at least about 8 barrels per minute. The matrix rate and/or the rate sufficient to form or enhance a fracture in the subterranean formation may vary depending on a number of factors, including, among other things, the composition of displacement fluid used, the structure and/or composition of the subterranean formation, the dimensions of a well bore penetrating the subterranean formation, the length of the interval being treated, the presence of a well bore penetrating the subterranean formation, whether a well bore penetrating the subterranean formation is a cased hole or an open hole, the number of perforations in the casing in a well bore (e.g., in those embodiments where the well bore comprises a cased or partially-cased hole), and the like. A person of ordinary skill in the art, with the benefit of this disclosure, will recognize what these rates are for a particular application of the present invention, and/or will be able to employ appropriate methods to determine these rates for a particular application of the present invention.

Figure 2:
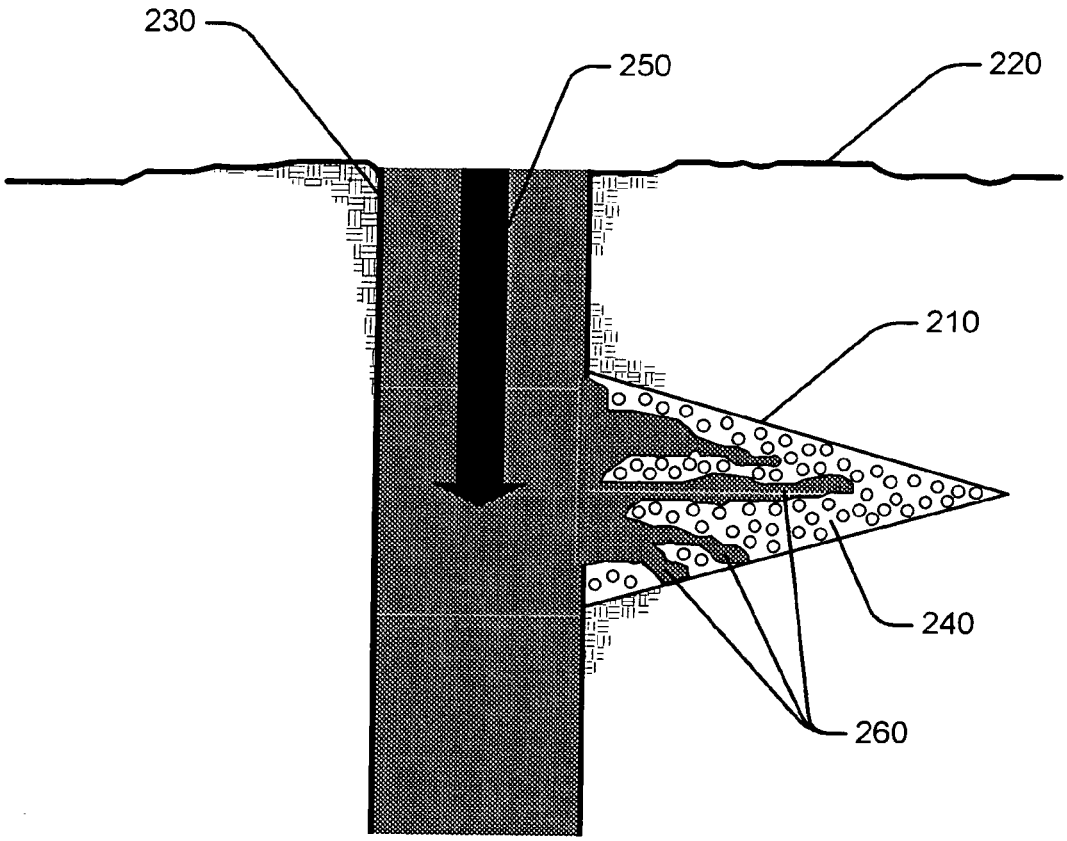
FIG. 2 illustrates a fracture being treated in one portion of a method of the present invention.

By way of example but not limitation, one embodiment of the present invention wherein the channels are formed in a propped fracture is illustrated in FIG. 2. In this embodiment, the displacement fluid 250 is introduced a subterranean formation 220 in communication with a well bore 230 at a rate equal to or greater than the matrix rate of the subterranean formation but less than the rate sufficient to form or enhance a fracture, e.g. 210 in the subterranean formation. The displacement fluid 250 thereby displaces at least a portion of the proppant particulates in the proppant pack 240 away from the well bore 230 to form conductive channels 260 in the proppant pack 240.

The channels formed in the propped fracture in the methods of the present invention may be in any number and of any size sufficient to provide the desired degree of conductivity through the propped fracture, which will be recognized by a person skilled in the art. In certain embodiments, the channels may have a width of about 0.25 inches, a height in the range of from about 0.5 inches to 2 inches, and/or a length in the range of from about 3 feet to about 10 feet.

The displacement fluids of the present invention generally comprise any fluid that does not adversely interact with the other components used in accordance with this invention and/or with the subterranean formation. For example, the displacement fluid may be an aqueous-based fluid, a hydrocarbon-based fluid (e.g., kerosene, xylene, toluene, diesel, oils, etc.), a foamed fluid (e.g., a liquid that comprises a gas), a gas (e.g., nitrogen or carbon dioxide), or a combination thereof. Suitable aqueous-based fluids may comprise fresh water, salt water, brine, or seawater, or any other aqueous fluid that does not adversely react with the other components used in accordance with this invention or with the subterranean formation.

The displacement fluids of the present invention optionally may comprise one or more gelling agents. The gelling agents used in the present invention may comprise any substance (e.g. a polymeric material) capable of increasing the viscosity of a fluid. The gelling agents may be naturally-occurring gelling agents, synthetic gelling agents, or a combination thereof. The gelling agents also may be cationic gelling agents, anionic gelling agents, or a combination thereof. In certain embodiments, suitable gelling agents may comprise polysaccharides, biopolymers, and/or derivatives thereof that contain one or more of these monosaccharide units: galactose, mannose, glucoside, glucose, xylose, arabinose, fructose, glucuronic acid, or pyranosyl sulfate. The term "derivative," as used herein, includes any compound that is made from one of the listed compounds, for example, by replacing one atom in the listed compound with another atom or group of atoms, rearranging two or more atoms in the listed compound, ionizing one of the listed compounds, or creating a salt of one of the listed compounds. Examples of suitable polysaccharides include, but are not limited to, guar gums (e.g., hydroxyethyl guar, hydroxypropyl guar, carboxymethyl guar, carboxymethylhydroxyethyl guar, and carboxymethylhydroxypropyl guar ("CMHPG")), cellulose derivatives (e.g., hydroxyethyl cellulose, carboxyethylcellulose, carboxymethylcellulose, and carboxymethylhydroxyethylcellulose), xanthan, scleroglucan, diutan, derivatives thereof, and combinations thereof. In certain embodiments, the gelling agents comprise an organic carboxylated polymer, such as CMHPG.

Suitable synthetic polymers include, but are not limited to, 2,2'-azobis(2,4-dimethyl valeronitrile), 2,2'-azobis(2,4-dimethyl-4-methoxy valeronitrile), polymers and copolymers of acrylomide ethyltrimethyl ammonium chloride, acrylamide, acrylamido- and methacrylamido-alkyl trialkyl ammonium salts, acrylamidomethylpropane sulfonic acid, acrylamidopropyl trimethyl ammonium chloride, acrylic acid, dimethylaminoethyl methacrylamide, dimethylaminoethyl methacrylate, dimethylaminopropyl methacrylamide, dimethylaminopropylmethacrylamide, dimethyldiallylammonium chloride, dimethylethyl acrylate, fumaramide, methacrylamide, methacrylamidopropyl trimethyl ammonium chloride, methacrylamidopropyldimethyl-n-dodecylammonium chloride, methacrylamidopropyldimethyl-n-octylammonium chloride, methacrylamidopropyltrimethylammonium chloride, methacryloylalkyl trialkyl ammonium salts, methacryloylethyl trimethyl ammonium chloride, methacrylylamidopropyldimethylcetylammonium chloride, N-(3-sulfopropyl)-N-methacrylamidopropyl-N,N-dimethyl ammonium betaine, N,N-dimethylacrylamide, N-methylacrylamide, nonylphenoxypoly(ethyleneoxy)ethylmethacrylate, partially hydrolyzed polyacrylamide, poly 2-amino-2-methyl propane sulfonic acid, polyvinyl alcohol, sodium 2-acrylamido-2-methylpropane sulfonate, quaternized dimethylaminoethylacrylate, quaternized dimethylaminoethylmethacrylate, and mixtures and derivatives thereof.

In certain embodiments, the gelling agent comprises an acrylamide/2-(methacryloyloxy)ethyltrimethylammonium methyl sulfate copolymer. In certain embodiments, the gelling agent may comprise an acrylamide/2-(methacryloyloxy) ethyltrimethylammonium chloride copolymer. In certain embodiments, the gelling agent may comprise a derivatized cellulose that comprises cellulose grafted with an allyl or a vinyl monomer, such as those disclosed in U.S. Pat. Nos. 4,982,793, 5,067,565, and 5,122,549, the relevant disclosures of which are incorporated herein by reference.

The gelling agent may be present in the displacement fluids used in the present invention in an amount sufficient to provide the desired viscosity. In some embodiments, the gelling agents (i.e., the polymeric material) may be present in an amount in the range of from about 0.1% to about 10% by weight of the displacement fluid. In certain embodiments, the gelling agents may be present in an amount in the range of from about 0.15% to about 2.5% by weight of the displacement fluid.

In certain embodiments where the displacement fluid comprises a gelling agent, the gelling agent may comprise polymers that have at least two molecules that are capable of forming a crosslink in a crosslinking reaction in the presence of a crosslinking agent, and/or polymers that have at least two molecules that are so crosslinked (i.e., a crosslinked gelling agent). The crosslinking agents may comprise a borate, a metal ion, or similar component that is capable of crosslinking at least two molecules of the gelling agent. Examples of suitable crosslinking agents include, but are not limited to, borate ions, magnesium ions, zirconium IV ions, titanium IV ions, aluminum ions, antimony ions, chromium ions, iron ions, copper ions, magnesium ions, and zinc ions. These ions may be provided by providing any compound that is capable of producing one or more of these ions. Examples of such compounds include, but are not limited to, ferric chloride, boric acid, disodium octaborate tetrahydrate, sodium diborate, pentaborates, ulexite, colemanite, magnesium oxide, zirconium lactate, zirconium triethanol amine, zirconium lactate triethanolamine, zirconium carbonate, zirconium acetylacetonate, zirconium malate, zirconium citrate, zirconium diisopropylamine lactate, zirconium glycolate, zirconium triethanol amine glycolate, zirconium lactate glycolate, titanium lactate, titanium malate, titanium citrate, titanium ammonium lactate, titanium triethanolamine, and titanium acetylacetonate, aluminum lactate, aluminum citrate, antimony compounds, chromium compounds, iron compounds, copper compounds, zinc compounds, and combinations thereof. In certain embodiments of the present invention, the crosslinking agent may be formulated to remain inactive until it is "activated" by, among other things, certain conditions in the fluid (e.g., pH, temperature, etc.) and/or interaction with some other substance. In some embodiments, the crosslinking agent may be delayed by encapsulation with a coating (e.g., a porous coating through which the crosslinking agent may diffuse slowly, or a degradable coating that degrades downhole) that delays the release of the crosslinking agent until a desired time or place. The choice of a particular crosslinking agent will be governed by several considerations that will be recognized by one skilled in the art, including but not limited to the following: the type of gelling agent included, the molecular weight of the gelling agent(s), the conditions in the subterranean formation being treated, the safety handling requirements, the pH of the displacement fluid, temperature, and/or the desired delay for the crosslinking agent to crosslink the gelling agent molecules.

When included, suitable crosslinking agents may be present in the displacement fluids used in the present invention in an amount sufficient to provide, inter alia, the desired degree of crosslinking between molecules of the gelling agent. In certain embodiments, the crosslinking agent may be present in the displacement fluids used in the present invention in an amount in the range of from about 0.0005% to about 1% by weight of the fluid. In certain embodiments, the crosslinking agent may be present in the displacement fluids used in the present invention in an amount in the range of from about 0.005% to about 1% by weight of the fluid. One of ordinary skill in the art, with the benefit of this disclosure, will recognize the appropriate amount of crosslinking agent to include in a displacement fluid used in the present invention based on, among other things, the temperature conditions of a particular application, the type of gelling agents used, the molecular weight of the gelling agents, the desired degree of viscosification, and/or the pH of the displacement fluid.

In certain embodiments, the displacement fluids used in the present invention optionally may comprise a resin, a tackifying agent, and/or a gelable liquid composition, inter alia, to aid in consolidating proppant particulates in the displacement fluid and/or the propped fracture. These resins, tackifying agents, and/or gelable liquid compositions may comprise any of those described.

In certain embodiments, the displacement fluid optionally may comprise a second plurality of particulates that are larger than the proppant particulates in the propped fracture. This second plurality of proppant particulates may comprise gravel and/or proppant particulates that are larger than those proppant particulates in the propped fracture. Where included, the second plurality of proppant particulates may comprise any type of proppant particulate listed above, including but not limited to proppant particulates that have been coated with a resin or tackifying agent. Where the displacement fluid comprises a second plurality of proppant particulates, at least a portion of that second plurality of proppant particulates may be placed in one or more of the channels formed according to the present invention, which is referred to herein as a "propped channel". A person of skill in the art, with the benefit of this disclosure, will recognize when the use of a displacement fluid comprising a second plurality of proppant particulates is appropriate for a particular application of the present invention.

In certain embodiments of the present invention, the displacement fluid may be a "proppant-free displacement fluid," which refers to a displacement fluid that comprises less than a substantial amount of proppant particulates. In certain embodiments of the present invention, a "proppant-free displacement fluid" may comprise less than about 0.2 pounds of proppant particulates per gallon of the displacement fluid. In certain embodiments of the present invention (e.g., where a proppant-free displacement fluid is used), one or more of the channels created in the propped fracture may comprise less than a substantial amount of proppant particulates, which is referred to herein as a "proppant-free channel". A person of skill in the art, with the benefit of this disclosure, will recognize when the use of a proppant-free displacement fluid is appropriate for a particular application of the present invention.

The displacement fluids used in methods of the present invention optionally may comprise any number of additional additives, including, but not limited to, salts, surfactants, gel stabilizers, acids, fluid loss control additives, gas, foamers, corrosion inhibitors, scale inhibitors, catalysts, clay control agents, biocides, bactericides, friction reducers, antifoam agents, bridging agents, dispersants, flocculants, $H_2S$ scavengers, $CO_2$ scavengers, oxygen scavengers, lubricants, viscosifiers, weighting agents, pH adjusting agents (e.g., buffers), relative permeability modifiers, solubilizers, and the like. A person skilled in the art, with the benefit of this disclosure, will recognize the types of additives that may be included in the displacement fluids for a particular application.

After the channels are formed in the propped fracture, the proppant particulates surrounding the channels optionally may be allowed to at least partially consolidate (e.g., to become adhered or attached to adjacent proppant particulates to form a solid, permeable mass). In certain embodiments, the proppant particulates may become consolidated with a resin, a tackifying agent, or a gelable liquid composition that is present as an additive in the displacement fluid and/or introduced into the propped fracture after the channels are formed. In certain embodiments, the proppant particulates themselves may have been previously coated with a resin, a tackifying agent, or a gelable liquid composition that allows the particulates to become consolidated. In those embodiments where the proppant particulates are allowed to consolidate, they may become consolidated at any time after one or more channels are formed in the propped fracture. In certain embodiments, the proppant particulates may be allowed to at least partially consolidate before the displacement fluid is recovered or allowed to leak-off into the subterranean formation. In other embodiments, the proppant particulates may be allowed to consolidate only after the displacement fluid is recovered or allowed to leak-off into the subterranean formation.

Figure 3:
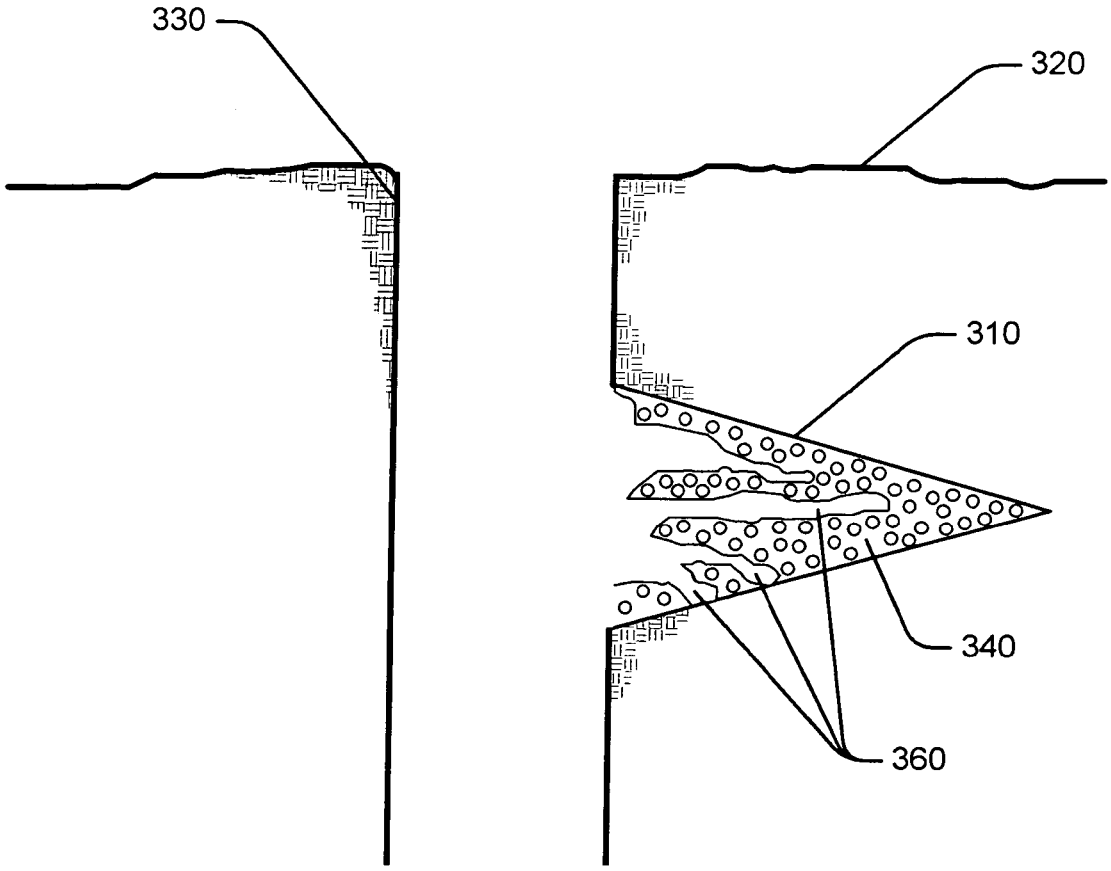
FIG. 3 illustrates a fracture that has been treated with a method of the present invention.
Figure 4:
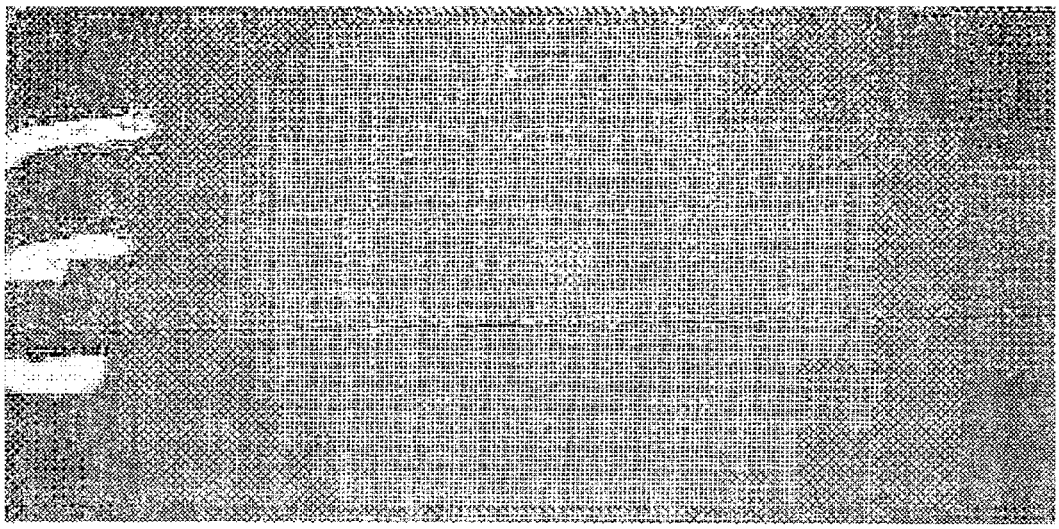
FIG. 4 illustrates some data obtained from computational modeling of a fracture treated with certain methods of the present invention.
Figure 5:
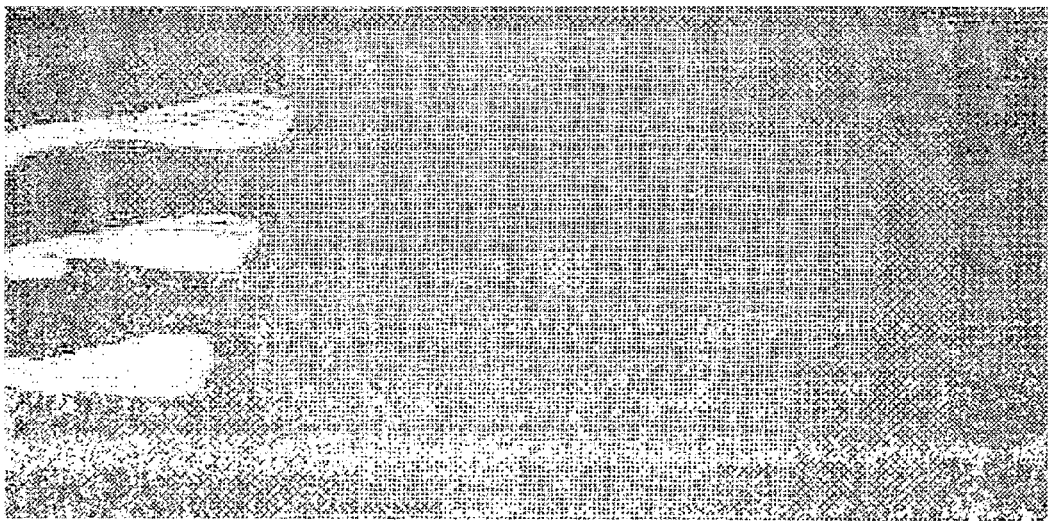
FIG. 5 illustrates some data obtained from computational modeling of a fracture treated with certain methods of the present invention.
Figure 6:
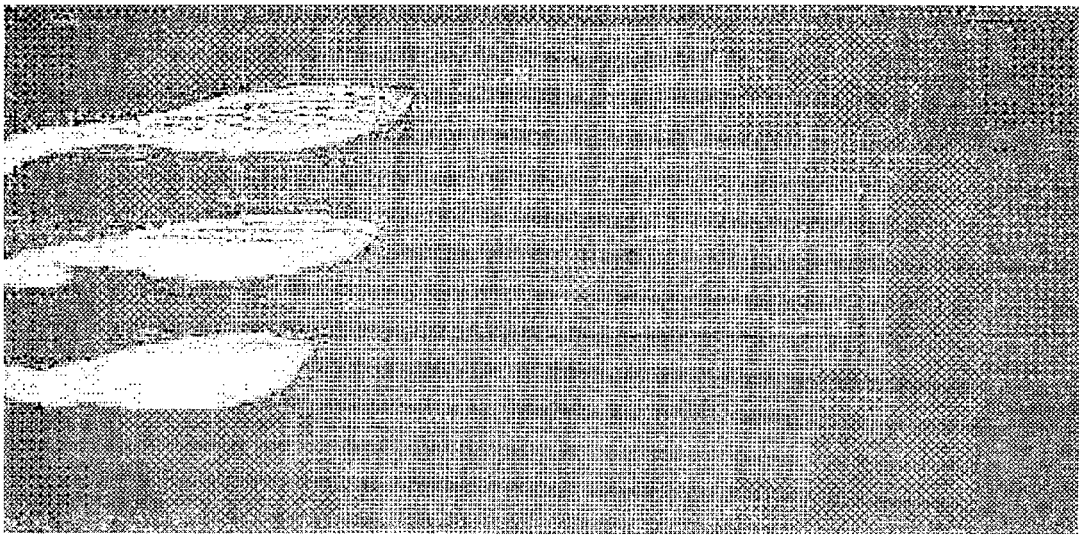
FIG. 6 illustrates some data obtained from computational modeling of a fracture treated with certain methods of the present invention.
Figure 7:
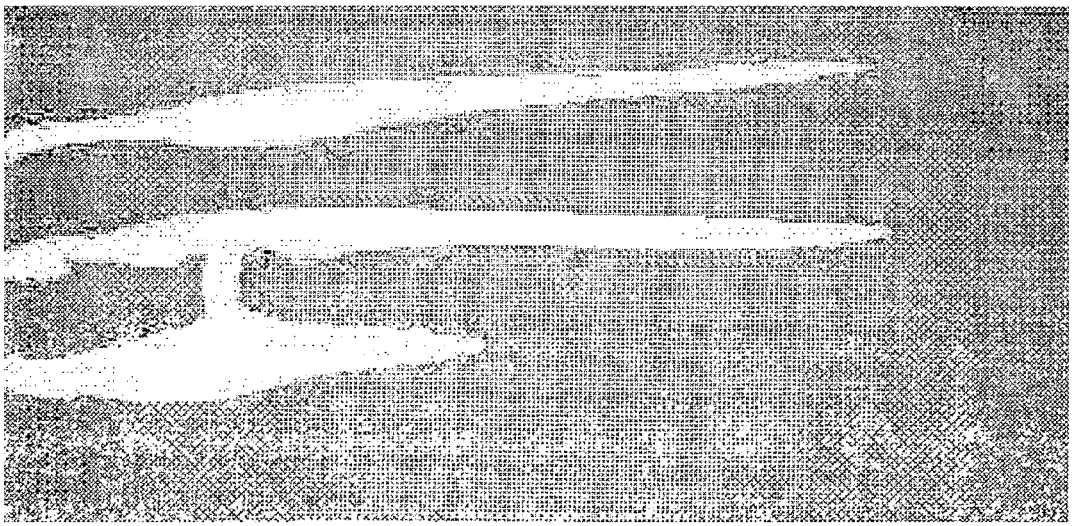
FIG. 7 illustrates some data obtained from computational modeling of a fracture treated with certain methods of the present invention.

After the channels are formed in the propped fracture, the displacement fluid may be recovered from the formation (e.g., by flowing back the well bore) and/or allowed to leak off into the formation. An example of a propped fracture after the displacement fluid has been recovered from the subterranean formation is illustrated in FIG. 3. FIG. 3 shows a fracture 310 in the subterranean formation 320 that is in communication with a well bore 330. When the displacement fluid is recovered through the well bore 330, the channels 360 in the proppant pack 340 may remain open and intact (e.g., by allowing the proppant particulates to consolidate after one or more of the channels are formed in the propped fracture), which may, among other things, increase the flow of fluids through the propped fracture 310.

In certain embodiments, the recovery and/or leak-off of the displacement fluid may be facilitated by reducing the viscosity of the displacement fluid, for example, with the use of a breaker. Where used, the breaker may comprise any substance that is capable of reducing the viscosity of the displacement fluid. Examples of breakers that may be used in the present invention include enzymes, oxidizers, acid buffers, and delayed breakers. The breaker may be added to the displacement fluid at the time that recovery and/or leak-off is desired, and/or the displacement fluid may comprise an internal breaker. In certain embodiments, an internal breaker may be formulated to become "activated" after the passage of a certain period of time or when contacted with another substance. Suitable delayed gel breakers may be materials that are slowly soluble in water, those that are encapsulated, or those that are otherwise designed to slowly solubilize in the fluid. In certain embodiments wherein these types of breakers are used, the breaking of the gel does not take place until the slowly soluble breakers are at least partially dissolved in the water. Examples of such slowly-soluble breakers are given in U.S. Pat. No. 5,846,915 issued to Smith et al. on Dec. 8, 1998, the relevant disclosure of which is herein incorporated by reference. Hard-burned magnesium oxide, especially that having a particle size which will pass through a 200 mesh Tyler screen, is a preferred delayed gel breaker. Other breakers such as alkali metal carbonates, alkali metal bicarbonates, alkali metal acetates, other alkaline earth metal oxides, alkali metal hydroxides, amines, weak acids and the like can be encapsulated with slowly-water soluble or other similar encapsulating materials so as to make them act after a desired delay period. Such materials are well known to those skilled in the art and function to delay the breaking of the gelled liquid hydrocarbon for a required period of time. Examples of water soluble and other encapsulating materials that may be suitable include, but are not limited to, porous solid materials such as precipitated silica, elastomers, polyvinylidene chloride (PVDC), nylon, waxes, polyurethanes, polyesters, cross-linked partially hydrolyzed acrylics and the like.

Another type of breaker which can be utilized when the gelling agent is a ferric iron polyvalent metal salt of phosphoric acid ester is a reducing agent that reduces ferric iron to ferrous iron. Of the various oxidation states of iron, ferric iron is capable of forming a viscosifying coordination salt with a phosphoric acid ester, therefore the salt may be disassociated by reducing the ferric iron to the ferrous state. The disassociation may cause the reduced volatility gelled liquid hydrocarbon treatment fluid to break. Examples of reducing agents which can be utilized include, but are not limited to, stannous chloride, thioglycolic acid, hydrazine sulfate, sodium diethyldithiocarbamate, sodium dimethyldithiocarbamate, sodium hypophosphite, potassium iodide, hydroxylamine hydrochloride, 2-mercaptoethanol, ascorbic acid, sodium thiosulfate, sodium dithionite, and sodium sulfite. Suitable reducing agents for use at a temperature of about 90° F. may include stannous chloride, thioglycolic acid, hydrazine sulfate, sodium diethyldithiocarbamate, and sodium dimethyldithiocarbamate. As mentioned above in connection with other breakers that can be used, the reducing agent utilized also can be delayed by encapsulating it with a slowly-water soluble or other similar encapsulating material.

If used, the breaker is generally present in or added to the displacement fluid in an amount in the range of from about 0.01% to about 3% by weight of the displacement fluid, more preferably in an amount in the range of from about 0.05% to about 0.5% by weight of the displacement fluid.

The methods of the present invention may be used prior to, in combination with, or after any type of subterranean operation being performed in the subterranean formation, including but not limited to fracturing operations, gravel-packing operations, frac-packing operations (i.e., combination of fracturing and gravel-packing operations), and the like. For example, the methods of the present invention may be used at some time after a fracture is created, wherein the methods of the present invention are used to at least partially consolidate proppant particulates placed within one or more fractures created or enhanced during the fracturing operation.

The methods of the present invention may be used to treat fractures along long sections of a well bore, or they may be performed in restricted, shorter intervals that are isolated from the remainder of the well bore, for example, using a diversion tool. For example, in certain embodiments, the methods of the present invention may be used to treat fractures along a portion of a well bore that is less than about 5 feet long. Suitable diversion tools may comprise diverting fluids (e.g., aqueous-base and/or non-aqueous-base diverting fluids), emulsions, gels, foams, degradable materials (e.g., polyesters, orthoesters, poly(orthoesters), polyanhydrides, dehydrated organic and/or inorganic compounds), particulates, packers (e.g., pinpoint packers, selective injection packers, inflatable straddle packers, and opposing washcup packers), ball sealers, pack-off devices, particulates, sand plugs, bridge plugs, and the like. In those embodiments where a shorter interval is treated, these treatments may, inter alia, minimize the massive transport of proppant away from the well bore.

To facilitate a better understanding of the present invention, the following examples of certain aspects of some embodiments are given. In no way should the following examples be read to limit, or define, the scope of the invention.

EXAMPLES

Example 1

In a physical testing using a slot model, a cement slurry was used to simulate proppant. The cement slurry was injected into a transparent acrylic slot model which has a dimension of 30 inches in height, 144 inches in length, and 0.5 inches in slot width. The slot model had 3 perforations of 0.5 inches in diameter at the entry and exit ends. The bottom-side perforations of both ends of the model were shut off during injection of the slurry into the model. The injection rate of cement slurry into the slot model was maintained at 10 gallons per minute until the entire slot was filled with cement slurry. After the model was filled, the cement slurry was allowed to stabilize for 5 minutes. A linear gel displacement fluid prepared from 30 pounds of a guar-based polymer per thousand gallons of fluid was injected into the cement-filled model at 5 gallons per minute through the middle perforation. It was observed that a cement-free channel was formed adjacent to the perforation and several smaller channels were branched out within the cement filled slot.

Thus, Example 1 illustrates that the methods of the present invention may enhance the conductivity of a propped fracture in a subterranean formation.

Example 2

Simulations of pumping a gel through concentrated, unconsolidated sand slurry in a fracture were performed using a Fluent (ver. 6.1.22) computational fluid dynamics solver available from Fluent, Inc., Lebanon, N.H. A proppant sand slurry was defined as having a density of 12 $lb_m$/gal and a Herschel-Buckley rheology model with a consistency index of 1000 cP $s^{n-1}$, a power-law index of 0.6, and a yield stress of 0.015 psi. The displacement fluid was defined as having a density of 8.33 $lb_m$/gal and a Newtonian viscosity of 1000 cP. The fracture dimensions are defined by 10 feet in height, 20 feet in length, and 0.5 inches in width. Perforations with diameter of 0.25 inches were spaced 2 feet apart at the center of the inlet of the fracture. The computational analysis assumed that the displacement fluid was injected through the perforations at a velocity of 1 foot per second, and that fluid was able to exit the fracture at the far end. The results of this computerized simulation are depicted graphically in FIGS. 4, 5, 6, and 7, which illustrate how the displacement fluid (the white area) would displace the proppant sand slurry to form channels in the proppant slurry (the gray area), at elapsed times of 91 seconds, 288 seconds, 454 seconds, and 784 seconds, respectively.

Thus, Example 2 illustrates that the methods of the present invention may enhance the conductivity of a propped fracture in a subterranean formation.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method comprising:

providing a propped fracture in a subterranean formation wherein a plurality of proppant particulates form a proppant pack that resides in at least a portion of the fracture;

providing a displacement fluid wherein the displacement fluid comprises a liquid additive selected from the group consisting of resins, tackifying agents, derivatives thereof, and combinations thereof;

introducing the displacement fluid into the propped fracture in the subterranean formation at the matrix rate of the subterranean formation;

allowing the displacement fluid to displace at least a portion of the plurality of proppant particulates, thereby forming at least one conductive channel within the proppant pack in the propped fracture; and, allowing the liquid additive in the displacement fluid to consolidate at least a portion of the plurality of proppant particulates.

2. The method of claim 1 wherein the proppant particulates are selected from the group consisting of sand, bauxite, ceramic materials, glass materials, polymer materials, nut shell pieces, seed shell pieces, cured resinous particulates, fruit pit pieces, wood, composite particulates, and combinations thereof.

3. The method of claim 1 wherein the proppant particulates comprise sand.

4. The method of claim 1 wherein at least a portion of the proppant particulates are at least partially coated with a coating selected from the group consisting of resins, tackifying agents, gelable liquid compositions, derivatives thereof, and combinations thereof.

5. The method of claim 1 wherein the step of allowing at least a portion of the proppant particulates to consolidate occurs after the step of forming at least one conductive channel within the proppant pack in the propped fracture.

6. The method of claim 1 wherein the matrix rate of the subterranean formation is about 0.25 barrels of fluid per minute and the maximum matrix rate is below about 8 barrels of fluid per minute.

7. The method of claim 1 wherein:

the displacement fluid comprises a second plurality of proppant particulates wherein at least a portion of the second plurality of proppant particulates are larger than the proppant particulates in the propped fracture; and the conductive channel formed within the proppant pack in the propped fracture comprises a propped channel.

8. The method of claim 1 wherein the channel in the propped fracture comprises a width of about 0.25 inches.

9. The method of claim 1 wherein the channel in the propped fracture comprises a height in the range of from about 0.5 inches to about 2 inches.

10. The method of claim 1 wherein the channel in the propped fracture comprises a length in the range of from about 3 feet to about 10 feet.

11. The method of claim 1 further comprising recovering at least a portion of the displacement fluid from the subterranean formation.

12. A method comprising:

providing a treatment fluid;

contacting a subterranean formation with the treatment fluid at a rate above the matrix flow rate so as to create or enhance one or more fractures in a portion of the subterranean formation;

providing a plurality of proppant particulates;

introducing the plurality of proppant particulates into the one or more fractures to form a proppant pack in the subterranean formation wherein the proppant pack resides in at least a portion of the fracture;

providing a displacement fluid wherein the displacement fluid comprises a liquid additive selected from the group consisting of resins, tackifying agents, derivatives thereof, and combinations thereof and wherein the displacement fluid does not contain proppant particulates;

introducing the displacement fluid into the propped fracture in the subterranean formation at the matrix rate of the subterranean formation; and, allowing the displacement fluid to displace at least a portion of the plurality of proppant particulates, thereby forming at least one conductive channel within the proppant pack in the propped fracture; and, allowing the liquid additive in the displacement fluid to consolidate at least a portion of the plurality of proppant particulates.

13. The method of claim 12 wherein the matrix rate of the subterranean formation is above about 0.25 barrels of fluid per minute and below about 8 barrels of fluid per minute.

14. The method of claim 12 wherein the proppant particulates are selected from the group consisting of sand, bauxite, ceramic materials, glass materials, polymer materials, nut shell pieces, seed shell pieces, cured resinous particulates, fruit pit pieces, wood, composite particulates, and combinations thereof.

15. The method of claim 12 wherein at least a portion of the proppant particulates are at least partially coated with a coating selected from the group consisting of resins, tackifying agents, gelable liquid compositions, derivatives thereof, and combinations thereof.

16. The method of claim 12 wherein the step of allowing at least a portion of the proppant particulates to consolidate occurs after the step of forming at least one conductive channel within the proppant pack in the propped fracture.

17. The method of claim 12 wherein the matrix rate of the subterranean formation is about 0.25 barrels of fluid per minute and the maximum matrix rate is below about 8 barrels of fluid per minute.

* * * * *